US005708910A

United States Patent [19]

Fukano et al.

[11] Patent Number: 5,708,910

[45] Date of Patent: Jan. 13, 1998

[54] DEVICE FOR DETECTING INSUFFICIENT SHEET CONVEYANCE

[75] Inventors: Masahiko Fukano; Kunihiko Ishii, both of Osaka, Japan

[73] Assignee: Mita Industrial Co. Ltd., Osaka, Japan

[21] Appl. No.: 567,878

[22] Filed: Dec. 8, 1995

[30] Foreign Application Priority Data

Jan. 11, 1995 [JP] Japan ..... 7-002882
Jan. 11, 1995 [JP] Japan ..... 7-002883

[51] Int. Cl.[6] ..... G03G 15/00

[52] U.S. Cl. ..... 399/21; 399/381

[58] Field of Search ..... 355/203–206, 355/208, 316, 308, 309, 311; 399/16, 18, 21, 381; 271/258.01, 259, 261; 226/38, 45, 100

[56] References Cited

U.S. PATENT DOCUMENTS

| | | | |
|---|---|---|---|
| Re. 34,685 | 8/1994 | Negishi et al. | 355/206 |
| 3,917,142 | 11/1975 | Guarderas | 226/38 |
| 4,249,080 | 2/1981 | Pritchett et al. | 250/557 |
| 4,804,998 | 2/1989 | Miyazaki | 355/14 |
| 5,204,726 | 4/1993 | Choi | 355/316 |
| 5,237,378 | 8/1993 | McEwen | 355/309 |

FOREIGN PATENT DOCUMENTS

615940A2 9/1994 European Pat. Off. .

OTHER PUBLICATIONS

Patent Abstracts of Japan for Publication No. JP57107351.

Patent Abstracts of Japan for Appln. No. 60–143362.

*Primary Examiner*—William J. Royer
*Assistant Examiner*—Quana Grainger
*Attorney, Agent, or Firm*—Beveridge, DeGrandi, Weilacher & Young, LLP

[57] ABSTRACT

A jam detecting device according to the present invention quickly outputs a jam detection signal when a part of a sheet is insufficiently conveyed during conveyance. A discharge detecting switch 55 is provided in the vicinity of discharge rollers 36. In addition, a plurality of (for example, three) pulse output units 230, 231 and 232 are provided in relation to the discharge detecting switch 55. Each of the pulse output units 230, 231 and 232 is so constructed as to output a pulse as the sheet is moved. In a jam judging circuit 235, when a signal of the discharge detecting switch 55 is on, a jam signal is outputted on the basis of the fact that no pulses are applied for not less than a predetermined time period from at least one of the pulse output units 230, 231 and 232. When a Jam occurs, therefore, the jam can be quickly detected. Consequently, the jam can be detected before a large sheet is crumpled or is tangled with a delivery roller in an image forming apparatus, whereby measures against the jam is easily taken.

5 Claims, 6 Drawing Sheets

DEVICE FOR DETECTING INSUFFICIENT SHEET CONVEYANCE

BACKGROUND OF THE INVENTION

1. Field of the Invention

The present invention relates generally to an image forming apparatus capable of forming an image on a large-size transfer sheet, and more particularly, to a device provided in such an apparatus for detecting insufficient sheet conveyance sheet.

2. Description of the Prior Art

An electrophotographic copying machine has been widely used as adapted to illuminate and scan an original, form an electrostatic latent image on a photoreceptor by light reflected from the original, develop the electrostatic latent image into a toner image, and heat and fix the toner image on a transfer sheet. Some of these copying machines are capable of copying a large-size document original such as Japanese Industrial Standard (JIS) A0 size.

A copying machine capable of copying an original of large size comprises a reading mechanism capable of reading an original of large size, and further comprises a conveying mechanism for conveying a sheet of large size corresponding to the original.

A facsimile, a printer or the like, which forms an image on a sheet of large size, also comprises a mechanism for conveying the sheet of large size.

Consider a case where a large-size sheet is conveyed. In this case, even if a part of the sheet is in an insufficiently conveyed state (a so-called jam) because the sheet is large in size, the jam is not easily detected. The jam cannot, in some cases, be detected until the entire sheet conveyed enters a state where it is tangled with a delivery roller, for example.

In a conventional image forming apparatus such as a copying machine, a facsimile or a printer for conveying a large-size sheet, the problem of jam processing which can occur due to the fact that the conveyed sheet is large in size has not been fully solved.

SUMMARY OF THE INVENTION

Therefore, the present invention is directed to a jam detecting device for an image forming apparatus capable of conveying a large-size sheet, which can quickly output a jam detection signal when a part of the sheet is insufficiently conveyed during conveyance.

In a mode, the present invention is directed to a jam detecting device for an image forming apparatus of such a type as to convey a sheet along a conveying path, transfer an image on the sheet being conveyed, and fix the transferred image to the sheet, which is characterized by comprising pulse outputting means provided in the conveying path for outputting pulses as the sheet existing in the conveying path is moved, and jam judging means for judging that the sheet is insufficiently conveyed on the basis of the fact that no pulses are outputted for not less than a predetermined time period from the pulse outputting means.

In another mode, the present invention further comprises discharged sheet detecting means provided in a position of the conveying path for outputting a signal when the sheet exists in the position, the jam judging means judging that the sheet is insufficiently conveyed on the basis of the fact that the signal is outputted from the discharged sheet detecting means and no pulses are outputted for not less than a predetermined time period from the pulse outputting means.

In still another mode, the present invention is directed to a jam detecting device, in which a fixing device for fixing the transferred image to the sheet and a discharge roller for discharging the sheet outward from the image forming apparatus are arranged along the direction of conveyance in the conveying path, which is characterized in that the discharged sheet detecting means is arranged in the vicinity of the discharge roller, and the pulse outputting means is provided in relation to the discharged sheet detecting means.

In the above-mentioned modes, it is judged whether or not the existing sheet is moved, that is, is satisfactorily conveyed on the basis of the pulses outputted from the pulse outputting means. When the sheet exists but is not moved, therefore, it can be judged that the sheet is insufficiently conveyed. Particularly when the sheet is a long sheet, therefore, the detection of a jam of the sheet can be performed more quickly and accurately than the conventional detection of a jam. Therefore, it is possible to prevent the occurrence of the jam in such state that the long sheet becomes crumpled or tangled with a roller in the image forming apparatus.

In yet still another mode, the present invention is directed to a jam detecting device, which is characterized in that at least two pulse outputting means are arranged with predetermined spacing in a direction intersecting the direction in which the sheet is conveyed in the conveying path, and the jam judging means judges that the sheet is insufficiently conveyed on the basis of the fact that no pulses are outputted for not less than a predetermined time period from at least one of the two pulse outputting means.

In a further mode, the present invention is directed to a jam detecting device, which is characterized in that there are provided three pulse outputting means, one of the pulse outputting means and the remaining two pulse outputting means being respectively arranged at the center and both side ends of the conveying path.

In a still further mode, the present invention is directed to a jam detecting device, which is characterized in that the pulse outputting means is provided in the vicinity of an end on the downstream side of the conveying path as viewed from the direction in which the sheet is conveyed.

According to the above-mentioned modes, it is judged that the sheet is insufficiently conveyed on the basis of the fact that no pulses are outputted for not less than a predetermined time period from at least one of the plurality of pulse outputting means arranged with predetermined spacing in a direction intersecting the direction in which the sheet is conveyed.

When the conveyed sheet is a so-called wide-size sheet which is large in width (in a direction horizontally intersecting the direction of conveyance), the sheet is insufficiently conveyed at the left-side end even if it is sufficiently conveyed at the right-side end. In this case, if the number of jam detecting means is only one, it takes significantly wide to find the insufficient conveyance at the left-side end. At the time when the jam of the sheet is judged, a part of the sheet is wound around the delivery roller, is crumpled or is crushed.

In the present invention, the jam detecting device is so constructed that early jam detection is realized in view of the conventional device which cannot detect the jam of the sheet until such a state occurs. Specifically, a plurality of pulse outputting means are arranged in a direction intersecting the direction in which the sheet is conveyed. When no pulses are outputted for not less than a predetermined time period from at least one of the pulse outputting means, the insufficient conveyance of the sheet is immediately detected. The jam of the sheet can be thus detected correctly and quickly. As a result, the conveyance of the sheet can be stopped before the sheet is tangled with the roller or is crumpled in the copying machine.

In the above-mentioned mode, when the existence of the sheet is detected by the discharged sheet detecting means, the insufficient conveyance Of the sheet is detected on the basis of the fact that no pulses are outputted for not less than a predetermined time period from at least one of the pulse outputting means. Consequently, the jam can be detected more accurately.

According to the present invention, there can be provided a jam detecting device for an image forming apparatus capable of detecting, when the sheet is insufficiently conveyed, the insufficient conveyance quickly and accurately.

Particularly, it is possible to provide a device capable of immediately detecting, when the conveyed sheet is large and a part of the sheet is insufficiently conveyed, the jam of the sheet and capable of detecting, before the jam of the large-size sheet enters a jammed state in the image forming apparatus.

The foregoing and other objects, features, aspects and advantages of the present invention will become more apparent from the following detailed description of the present invention when taken in conjunction with the accompanying drawings.

DESCRIPTION OF THE EMBODIMENTS

Figure 1:
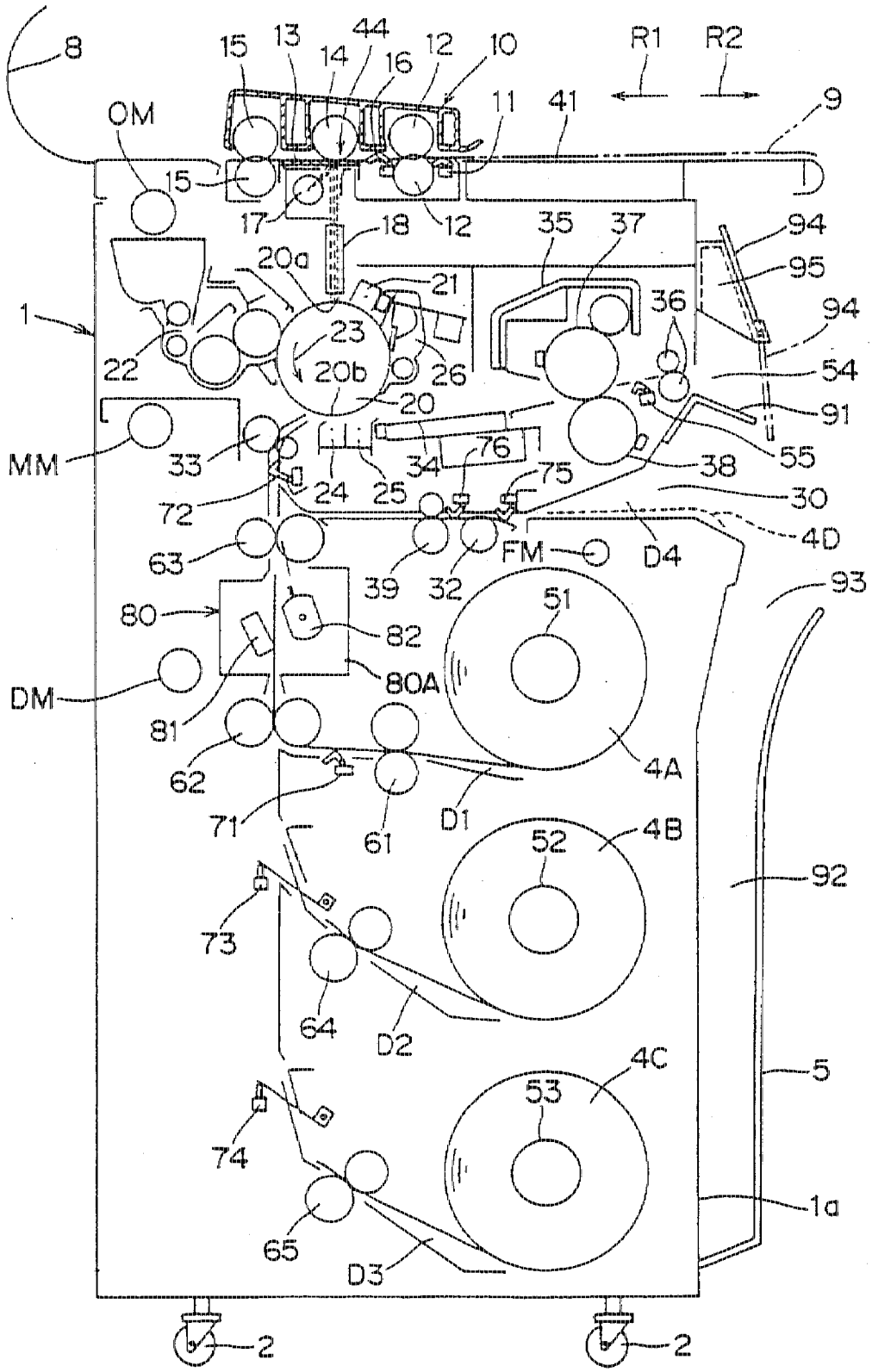
FIG. 1 is a cross sectional view schematically showing the internal construction of a copying machine according to one embodiment of the present invention.
Figure 2:
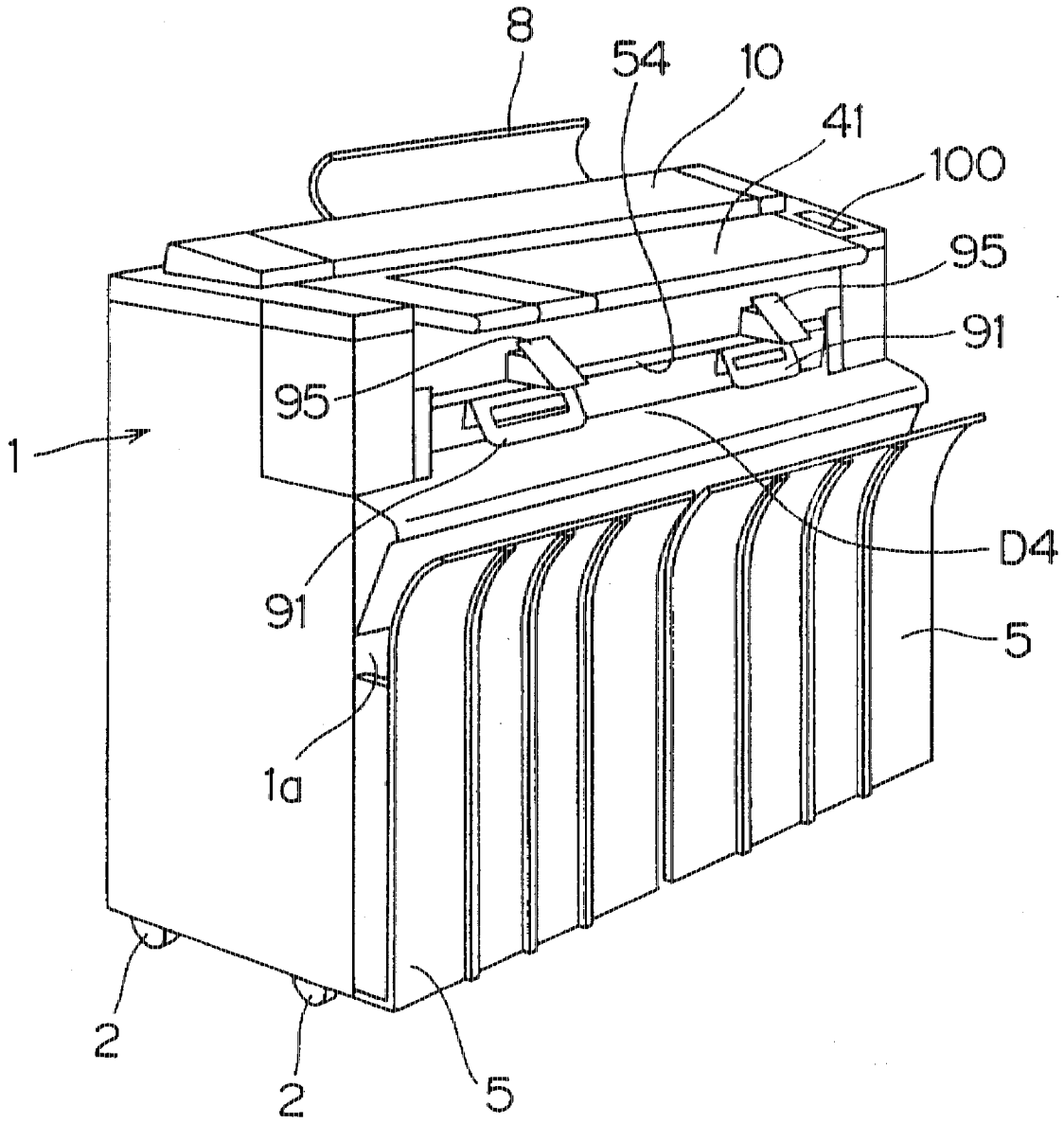
FIG. 2 is a perspective view showing the construction of the appearance of the copying machine according to one embodiment of the present invention.
Figure 3:
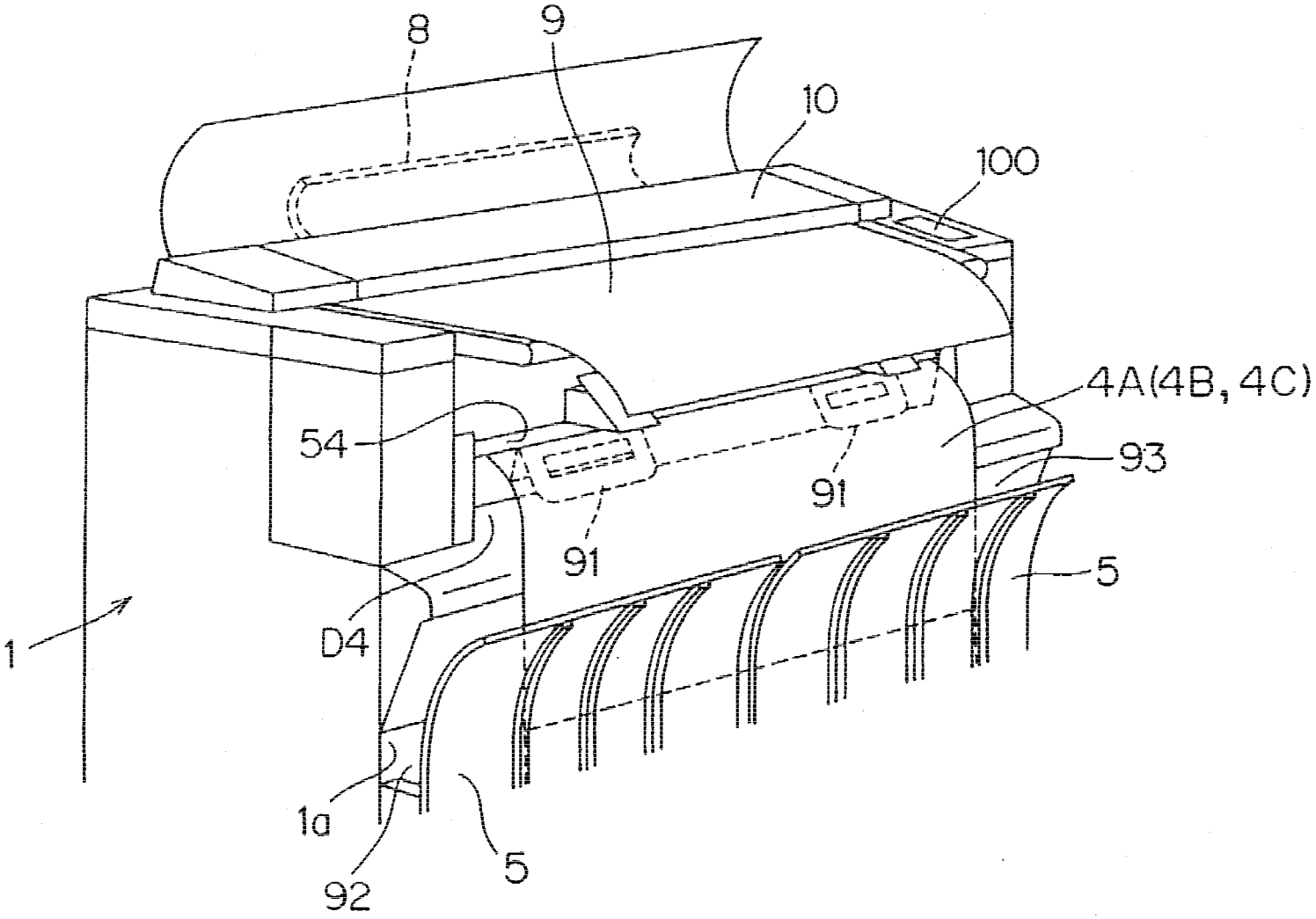
FIG. 3 is a perspective view showing the appearance at the time of copying by the copying machine according to one embodiment of the present invention.

FIG. 1 is a schematic sectional view illustrating the internal construction of a copying machine in accordance with one embodiment of the present invention. FIG. 2 is a perspective view illustrating the external construction of the copying machine, and FIG. 3 is a perspective view illustrating the appearance of the copying machine which is performing a copying operation. The copying machine is adapted to obtain an image of a large-size document original such as of JIS A0 size. In the copying machine, the document original is scanned under light irradiation by a stationary optical system while being transported, and an image is formed on the basis of the optical scanning.

Referring to FIG. 1, a machine body 1 has caster wheels 2 on the under side thereof for free movement. Referring to FIGS. 1 to 3, a document-original transportation section 10 for transporting a document original 9 along a document-original transportation path 41 formed is provided on the top face of the machine body 1. A discharge port 54 for discharging a sheet having a toner image transferred thereon opens in a front face 1*a* of the machine body 1. The sheet discharged from the discharge port 54 is guided by a guide member 91, dropped through a guide opening 93 with the leading edge thereof oriented downward, and accommodated in a pocket 92 defined by a front cover 5 provided along the front face 1*a* of the machine body 1, as shown in FIG. 3. On an edge portion of the top face of the machine body 1 is provided with an operation section 100 having switches, keys and the like for making various settings related to a copying operation.

Referring to FIG. 1, three roll sheets 4A, 4B and 4C which are located vertically in upper, middle and lower positions and each wound into a roll shape are accommodated within a portion between the vertically middle portion and the lower portion of the machine body 1. The roll sheets 4A, 4B and 4C are rolled around feed reels 51, 52 and 53, respectively. Examples of sheets to be used as these roll sheets 4A, 4B and 4C include normal paper, film and tracing paper. In the central portion of the machine body 1 is disposed a bypass transportation path D4 for feeding a cut-sheet preliminarily cut into a predetermined length such as of A0 size to A4 size through a manually sheet feeding section 30 provided on the front face 1*a* of the machine body 1.

The roll sheet 4A in the upper position is transported along a first transportation path D1 from the feed reel 51 to a photoreceptor drum 20 through the sheet feeding rollers 61, a first leading-edge detection switch 71 for detecting the leading edge of the transported roll sheet 4A, transportation rollers 62, a cutter mechanism 80, transportation rollers 63, a second leading-edge detection switch 72 for detecting the leading edge of the transported sheet 4A, 4B, 4C or 4D, and transportation rollers 33 in this order.

The roll sheet 4B in the middle position is transported along a second transportation path D2 from the feed reel 51 to the photoreceptor drum 20 through the sheet feeding rollers 64, a third leading-edge detection switch 73 for detecting the leading edge of the transported roll sheet 4B, the transportation rollers 62, the cutter mechanism 80, the transportation rollers 63, the second leading-edge detection switch 72, and the transportation rollers 33 in this order. The path downstream of the transportation rollers 62 is common to the first transportation path D1.

The roll sheet 4C in the lower position is transported along a third transportation path D3 from the feed reel 53 to the photoreceptor drum 20 through the sheet feeding rollers 65, a fourth leading-edge detection switch 74 for detecting the leading edge of the transported roll sheet 4C, the transportation rollers 62, the cutter mechanism 80, the transportation rollers 63, the second leading-edge detection switch 72, and the transportation rollers 33 in this order. The path downstream of the transportation rollers 62 is common to the first transportation path D1.

The bypass transportation path D4 is a path which leads the cut-sheet 4D introduced from the manual sheet feeding section 30 to the photoreceptor drum 20 through a fifth leading-edge detection switch 75 for detecting the leading edge of the transported cut-sheet, a separation roller 32 for separating cut-sheets one from another by an abut plate (not shown) abutted against the cut-sheets, a sixth leading-edge detection switch 76 for detecting the leading edge of the transported cut-sheet, resist rollers 39, the second leading-edge detection switch 72 and the transportation rollers 33 in this order. The path downstream of the second leading-edge detection switch 72 in the bypass transportation path D4 is common to the first transportation path D1.

The cutter mechanism 80 has an elongated stationary blade 81 provided in a casing 80A and extending in a direction perpendicular to a transportation direction of the roll sheet 4A, 4B or 4C, and a rotary blade 82 cooperating with the stationary blade 81 to cut the transported roll sheet 4A, 4B or 4C therebetween. The roll sheet 4A, 4B or 4C is transported upward through the cutter mechanism 80.

The document-original transportation section 10 is adapted to switch the transportation direction to either a regular direction R1 or a reverse direction R2 for the transportation of the document original 9. The image forming operation is performed when the document original is transported in the regular direction R1. When a plurality of copies are made from one document original, the document-original transportation section 10 alternates the regular transportation direction R1 and the reverse transportation direction R2 to transport the document original. The document-original transportation path 41 is provided upstream the document-original transportation section 10 with respect to the regular direction R1 on the top face of the machine body 1 and laterally projects from the top face of the machine body 1.

The document-original transportation section 10 has a first document-original edge detection switch 11, first transportation rollers 12, a second document-original edge detection switch 16, a second transportation roller 14 and third transportation rollers 15 arranged along the regular transportation direction R1 in this order.

The first transportation rollers 12 are driven in response to the detection of the leading edge (on the downstream side in the regular transportation direction R1) of the document original 9 when the first document-original edge detection switch 11 is switched on. The second transportation roller 14 facing opposite to a transparent plate 13 for exposing the document original 9 to slit light serves to press the document original 9 against the transparent plate 13. The third transportation rollers 15 serve to discharge the document original 9 after the light exposure.

The second document-original edge detection switch 16 is switched on when the document original 9 is transported therethrough in the regular transportation direction R1, thereby detecting the leading edge (with respect to the regular direction R1) of the document original 9. In response to the switch on of the second document-original edge detection switch 16, the transportation of the roll sheet 4A, 4B or 4C (hereinafter referred to simply as "roll sheet 4" when the term is used to explain the copying operation) is started, thereby coordinating the transportation of the roll sheet 4 with that of document original 9.

The first document-original edge detection switch 11 is switched off after the document original 9 is transported therethrough in the regular transportation direction R1, thereby detecting the tail edge (with respect to the regular direction R1) of the document original 9. The cutter mechanism 80 is driven at a preset time point a predetermined time period after the detection of the tail edge of the document original 9 to cut the roll sheet 4. In this embodiment, the length of the transportation path extending from the cutter mechanism 80 to an image transfer position 20*b* of a corona discharger 24 for image transfer is set longer than the length of the document-original transportation path extending from the first document-original edge detection switch 11 to a document-original light-exposure position 44 by a distance between the light exposure position 20*a* of the photoreceptor drum 20 and the image transfer position 20*b*, so that the tail edge of the sheet 4 cut at the preset time point can correspond to the tail edge of the document original 9 for image formation.

The second document-original edge detection switch 16 is switched off after the document original 9 is transported therethrough in the reverse transportation direction R2, thereby detecting the tail edge of the document original 9 transported in the reverse direction R2. In response to the switch off of the second document-original edge detection switch 16, the driving of the transportation rollers 12, 14 and 15 is stopped. At this time, the leading edge of the document original 9 is held between the transportation rollers 12 for the next copying operation. A reference numeral 8 denotes a reversion member for preventing the document original 9 from dropping to the rear side of the machine body 1 by reversing the transportation direction of the document original.

A stationary light source 17 for irradiating the document surface of the document original 9 is disposed in a predetermined relation with respect to the transparent plate 13. The light from the light source 17 is emitted onto the document surface through the transparent plate 13. The light reflected on the surface of the document original 9 is led to the surface of the photoreceptor drum 20 disposed in a generally central portion of the machine body 1 by means of a selfoc lens 18. Before being exposed to the light from the selfoc lens 18, the surface of the photoreceptor drum 20 is uniformly charged by a corona discharger 21 for electrostatic charging. After the light exposure, an electrostatic latent image corresponding to a document original image is formed on the surface of the photoreceptor drum 20. The electrostatic latent image is developed into a toner image by a developing unit 22. The toner image formed on the photoreceptor drum 20 is brought into the vicinity of the corona discharger 24 for image transfer, as the photoreceptor drum 20 is rotated in a direction indicated by the arrow 23.

On the other hand, the sheet 4 led to the photoreceptor drum 20 from the transportation path D1, D2 or D3 is led into the vicinity of the corona discharger 24 for image transfer with being brought into contact with the surface of the photoreceptor drum 20. Then, the toner image formed on the surface of the photoreceptor drum 20 is transferred onto the sheet 4 by way of corona discharge by the corona discharger 24 for image transfer. The sheet 4 having the toner image transferred thereon is removed from the surface of the photoreceptor drum 20 by way of corona discharge by a corona discharger 25 for sheet removal, and then led to a fixing unit 35 through the transportation path 34. In the fixing unit 35, toner is fixed onto the surface of the sheet 4 by heat-pressing the sheet 4 between a heat roller 37 and a press roller 38. The sheet 4 on which the toner is fixed is discharged out of the machine body 1 through a discharge detection switch 55 and discharge rollers 36, guided by the guide member 91, and accommodated in the pocket 92, as described above. After the toner image is transferred, the toner remaining on the surface of the photoreceptor drum 20 is removed by a cleaning unit 26 for the next electrostatic latent image formation.

Similarly, the cut-sheet 4D led to the photoreceptor drum 20 from the bypass sheet feeding path D4 is subjected to the toner image transfer and the toner fixation, and then discharged into the pocket 92.

Above the guide member 91 is disposed an auxiliary guide plate 94. The auxiliary guide plate 94 is pivotally supported by a stay 95 attached to the front face 1*a* of the machine body 1. The auxiliary guide plate 94 assumes either an attitude (indicated by a dashed line in FIG. 1) for guiding the discharged sheet 4 hanging down forwardly of the guide member 91 into the pocket 92 cooperatively with the guide member 91 or an attitude (indicated by a solid line in FIG. 1) for sheet accommodation in which the auxiliary guide plate 94 is supported by the stay 95. The attitude of the auxiliary guide plate 94 can be shifted by the pivotal movement thereof.

Image forming means is constituted by such members as the photoreceptor drum 20, the developing unit 22 and the corona discharger 24 for image transfer. In this embodiment, the copying machine further includes a main motor MM for driving the image forming means, a sheet feeding motor DM for driving the transportation rollers for feeding the sheet 4A, 4B, 4C and 4D, a fixation motor FM for driving the heat roller 37 and press roller 38 of the fixing unit 35, and a document-original feeding motor OM for driving the document original transportation section 10.

Figure 4:
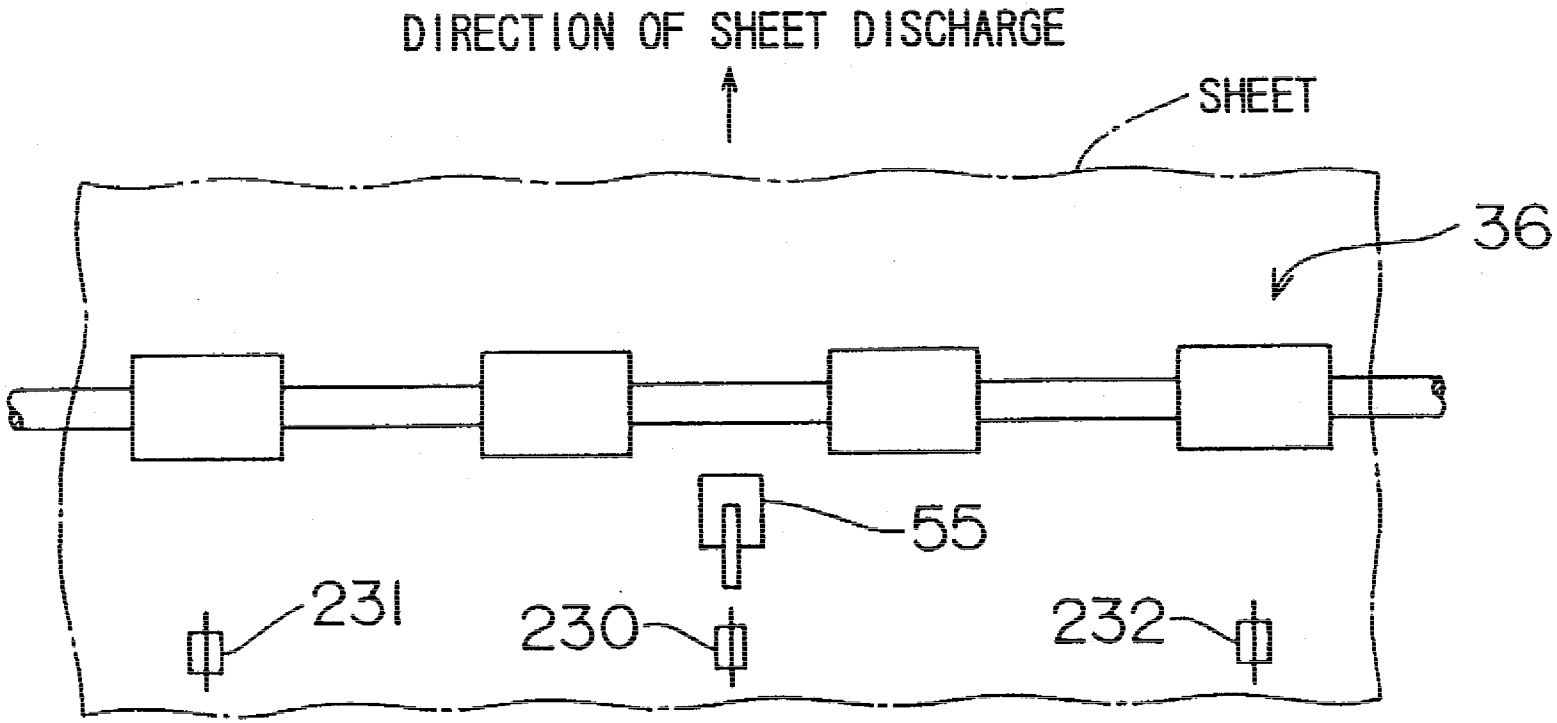
FIG. 4 is a plan view showing the construction in the vicinity of a discharge port in the copying machine according to one embodiment of the present invention.

FIG. 4 is a plan view showing the construction in the vicinity of the discharge port 54 in the copying machine according to the present embodiment. In FIG. 4, reference numeral 36 denotes the discharge rollers. A sheet to which a toner image has been fixed by the fixing device 35 (see FIG. 1) is discharged in the direction of sheet discharge by the discharge rollers 36. The discharge detecting switch 55 is provided on the upstream side of the discharge rollers 36 as viewed from the direction of sheet discharge (the direction of conveyance). The discharge detecting switch 55 is a switch which is turned on if the sheet exists, while being turned off if it does not exist.

Pulse output units 230, 231 and 232 are provided in the vicinity of the position where the discharge detecting switch 55 is arranged. In the present embodiment, there are provided three pulse output units. The three pulse output units 230, 231 and 232 are arranged with predetermined spacing in a direction horizontally intersecting the direction in which the sheet is conveyed. More specifically, the pulse output unit 230 is arranged in an approximately central position in the conveying path near the discharge detecting switch 55, and the pulse output units 231 and 232 are respectively arranged so as to abut against both side ends of the sheet.

Figure 5:
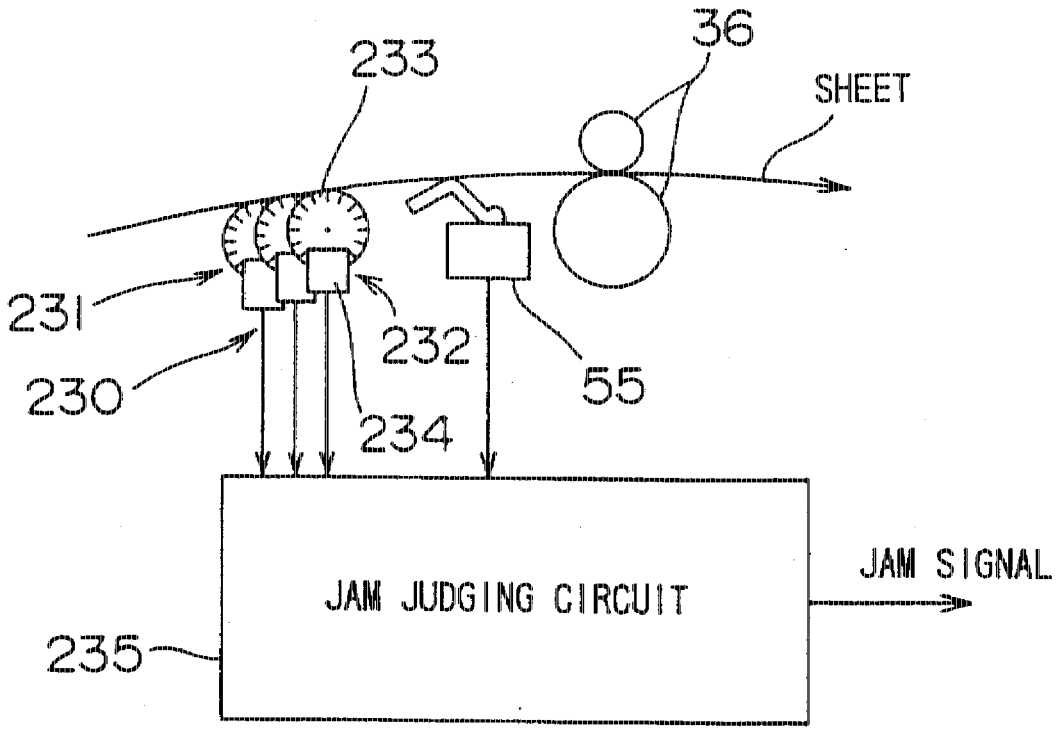
FIG. 5 is an illustration showing the construction of a jam detecting device according to one embodiment of the present invention.

FIG. 5 is an illustration showing the construction of a jam detecting device in the copying machine according to the present embodiment. As shown in FIG. 5, each of the pulse output units 230, 231 and 232 comprises a rotating disc 233 and a pair of light projecting and receiving elements 234. Each of the rotating discs 233 is rotatably arranged in the position where its peripheral surface is brought into contact with the sheet conveyed in the conveying path. Therefore, the rotating disc 233 rotates as the sheet passes through the conveying path. A number of slits are formed radially with respect to the center of rotation and equally spaced in a peripheral portion of the rotating disc 233. The pair of light projecting and receiving elements 234 is so arranged as to hold the rotating disc 233 in the peripheral portion of the rotating disc 233. Light emitted from the light projecting element is given to the light receiving element through the slits of the rotating disc 233.

By such construction, the sheet is conveyed in the conveying path, and the rotating disc 233 rotates as the sheet is moved. In the pair of light projecting and receiving elements 234, the light from the light projecting element the light receiving element is transmitted by the slits or is intercepted by a portion other than the slits as the rotating disc 233 rotates. Accordingly, an output of the light receiving element becomes a pulse signal responsive to intermittent receiving of the light. The pulse signal is outputted only when the sheet is moved.

Each of pulses outputted from the pulse output units 230, 231 and 232 is fed to a jam judging circuit 235. A signal of the discharge detecting switch 55 is also fed to the jam judging circuit 235. In the jam judging circuit 235, it is judged whether or not a jam occurs on the basis of the output state of the discharge detecting switch 55 and the presence or absence of pulse signals fed from the three pulse output units 230, 231 and 232. When it is judged that a jam occurs, a jam signal is outputted.

Figure 6:
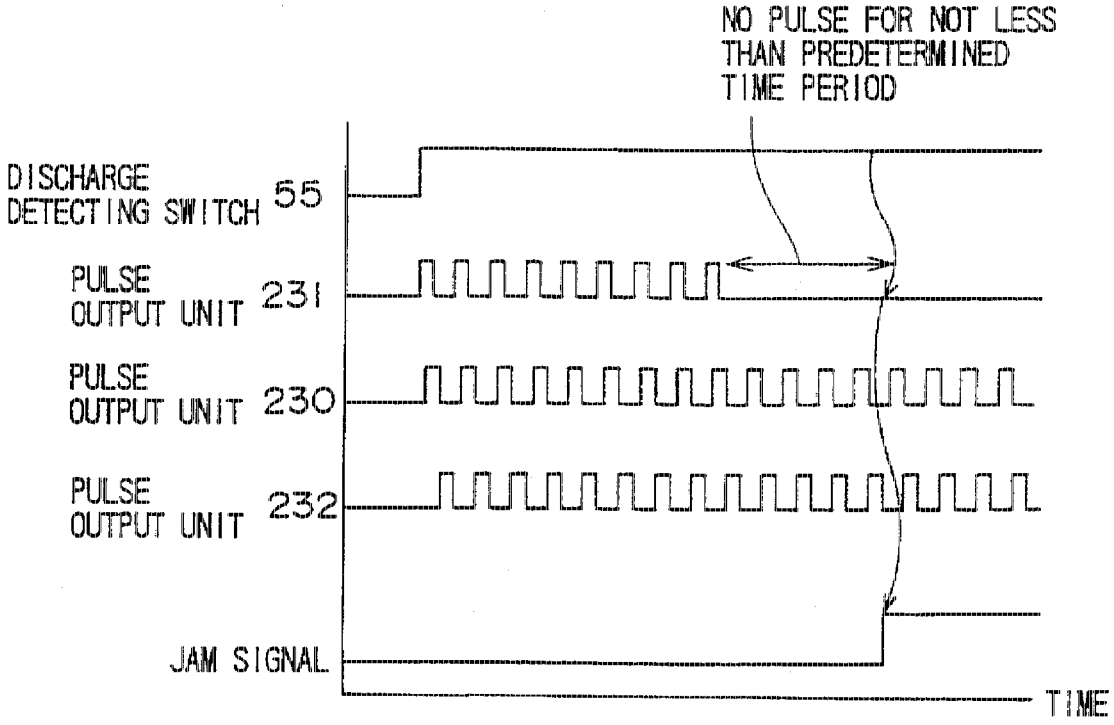
FIG. 6 is a timing chart for explaining a judging operation of a jam judging circuit shown in FIG. 5.

FIG. 6 is a timing chart for explaining a method of judging a jam in the jam judging circuit 235 shown in FIG. 5.

Referring to FIG. 6, in the Jam judging circuit 235, when no pulses are applied for not less than a predetermined time period from at least one of the three pulse output units 230, 231 and 232 in a case where a high level signal is fed from the discharge detecting switch 55, that is, in a state where the presence of the discharged sheet is detected by the discharge detecting switch 55, a jam signal is outputted.

When the conveyed sheet is very long in the direction of conveyance, it takes significantly long to detect a jam of the sheet by only the discharge detecting switch 55. The reason for this is that in a case where a jam is detected only by the discharge detecting switch 55, it can be judged that a jam occurs when the discharge detecting switch 55 is turned on for not less than a time period required for the sheet to pass through the discharge detecting switch 55. Therefore, it cannot be judged that a jam occurs until a high level signal continues to be inputted from the discharge detecting switch 55 for a relatively long time period. However, it takes too long to detect a jam.

In the present embodiment, when no pulses are outputted for not less than a predetermined time period from at least one of the pulse output units 230, 231 and 232 in a time period during which the discharge detecting switch 55 outputs a signal indicating that the sheet exists, it is immediately judged that a jam occurs. Consequently, a jam can be quickly detected. It is possible to prevent the occurrence of a jam where a long sheet is crumpled in the conveying path or is tangled with the discharge roller 36 or the like.

Furthermore, in the present embodiment, three pulse output units are arranged in a direction horizontally intersecting the direction in which the sheet is conveyed. One of the pulse output units is provided at the center in the conveying path, and the remaining two pulse output units are respectively provided at the right-side end and the left-side end in the conveying path. When a wide sheet is conveyed, therefore, a jam of the sheet can be detected correctly and quickly.

The reason for this is that in a case where the sheet is wide, the right-side or left-side end of the sheet may, in some cases, be waved or caught, resulting in insufficient conveyance even if the sheet is correctly conveyed at the center of the sheet. In other words, when the sheet is wide, the conveyed state subtly differs at the right-side end, the center and the left-side end in the width direction of the sheet. The jam of the sheet first locally occurs, which may lead to a jam of the entire sheet.

In the present embodiment, therefore, a plurality of pulse output units are arranged with predetermined spacing in a direction horizontally intersecting the direction in which the sheet is conveyed so that a jam of the sheet which locally occurs can be quickly detected.

In a case where the wide sheet is conveyed, therefore, it is possible to quickly detect, even when the sheet is insufficiently conveyed locally, the insufficient conveyance, and it is possible to stop a conveying device before the jam of the entire sheet enters a bad state.

In the present invention, the above described embodiment can be modified as follows.

A structure for detecting a jam of a sheet which is long in the direction of conveyance is possible by a discharge detecting switch 55 and one of pulse output units. When only one pulse output unit is used, the pulse output unit may be provided in the vicinity of the discharge detecting switch 55 or may be provided in a position spaced apart from the discharge detecting switch 55 by a predetermined distance in the direction of conveyance. In addition, the pulse output unit may be provided even in an arbitrary position such as a center position or an end side position as viewed from a direction horizontally intersecting the direction of conveyance.

On the other hand, in a case where a plurality of pulse output units are used, the discharge detecting switch 55 may be omitted. In a case where two pulse output units, for example, are used, pulses are simultaneously outputted from the two pulse output units if the sheet is satisfactorily conveyed. When a local jam or a jam of the entire sheet occurs, however, no pulses are outputted from at least one of the plurality of pulse output units. Therefore, it is possible to detect the jam of the sheet.

Furthermore, a plurality of pulse output units may be arranged not with predetermined spacing in a direction horizontally intersecting the direction in which the sheet is conveyed but in a direction intersecting the direction in which the sheet is conveyed.

Although in the above-mentioned embodiment, description was made of the vicinity of a discharge port by way of example, the same jam detecting device may be incorporated into an arbitrary position in a sheet conveying path.

The foregoing description was made of a jam detecting device provided in a copying machine by way of example. However, the present invention is also applicable to an image forming apparatus for conveying a large sheet such as a digital copying machine, a facsimile, or a printer in addition to the above-mentioned copying machine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A device for detecting insufficient conveyance of a sheet for an image forming apparatus of such a type as to convey a sheet the length of which is larger than the length of a conveying path by not less than a predetermined value along said conveying path, transfer an image on the sheet being conveyed, and fix the transferred image to the sheet, said device comprising:

discharged sheet detecting means provided in a position in the vicinity of an end on the downstream side of the conveying path for outputting a signal when the sheet is present in said position;

pulse outputting means provided remote from said discharged sheet detecting means for outputting pulses as the sheet is moved, said pulse outputting means having at least two pluse outputting devices arranged with predetermined spacing in a direction intersecting the direction in which the sheet is conveyed; and jam judging means for judging that the sheet is insufficiently conveyed when a signal is outputted by said discharged sheet detecting means and no pulses are outputted during a predetermined time period by said pulse outputting means.

2. A jam detecting device for an image forming apparatus of such a type as to convey a sheet along a conveying path, transfer an image onto the sheet being conveyed, and fix the transferred image to the sheet, said device comprising:

at least two pulse outputting means provided in arbitrary positions with respect to the conveying path and arranged with predetermined spacing in a direction intersecting the direction in which the sheet is conveyed, each of said pulse outputting means outputting a pulse as the sheet present in the conveying path is moved; and jam judging means for judging that the sheet is insufficiently conveyed when no pulses are outputted, during a predetermined time period, from at least one of said two pulse outputting means.

3. The jam detecting device for an image forming apparatus according to claim 2, wherein there are provided three pulse outputting means, one of said pulse outputting means and the remaining two of said pulse outputting means being respectively arranged at the center and both sides of the conveying path.

4. The jam detecting device according to claim 3, wherein said pulse outputting means is provided in the vicinity of an end on the downstream side of the conveying path as viewed from the direction in which the sheet is conveyed.

5. The jam detecting device according to claim 4, wherein discharged sheet detecting means for outputting a signal when the presence of the discharged sheet is detected is further provided in the vicinity of an end on the downstream side of the conveying path, and said jam judging means judges a jam when the signal is outputted from the discharged sheet detecting means.

* * * * *